US005197605A

United States Patent [19]

Hampton

[11] Patent Number: 5,197,605

[45] Date of Patent: Mar. 30, 1993

[54] VACUUM LINE MARKER KIT

[76] Inventor: James M. Hampton, 215 Baird Cover Rd., Franklin, N.C. 28734

[21] Appl. No.: 719,620

[22] Filed: Jun. 24, 1991

[51] Int. Cl.[5] ..... B65D 85/16

[52] U.S. Cl. ..... 206/582; 206/459.5; 138/89; 184/102; 184/16

[58] Field of Search ..... 138/89, 96 R; 123/469, 123/198 B; 184/102, 15.1, 16; 206/223, 582, 459, 338

[56] References Cited

U.S. PATENT DOCUMENTS

| | | | |
|---|---|---|---|
| 1,367,211 | 2/1921 | Smith | 184/16 |
| 2,589,593 | 3/1952 | Anderson et al. | 206/379 X |
| 4,182,153 | 1/1980 | Dawson | 206/223 X |
| 4,716,875 | 1/1988 | Troncoso, Jr. | 123/469 |
| 4,750,525 | 6/1988 | Vaughan | 138/89 |
| 4,874,084 | 10/1989 | Strausser | 206/338 X |
| 4,915,136 | 4/1990 | Bartholomew | 138/89 |
| 5,044,404 | 9/1991 | Watson | 138/89 |

*Primary Examiner*—Paul T. Sewell
*Assistant Examiner*—Jacob K. Ackun, Jr.
*Attorney, Agent, or Firm*—Leon Gilden

[57] ABSTRACT

A kit apparatus includes plural pairs of plug members of varying corresponding sizes, wherein at least one plug member of the pair includes a smooth cylindrical body, with an enlarged head mounted thereon for sealing relationship relative to vacuum line, wherein an opposed plug member of the pair includes a cylindrical body with an enlarged head and at least including a plurality of concentric sealing rings to enhance sealing securement with a corresponding vacuum line when a vacuum line is separated from a vacuum source, such as in a carburetor in an automotive environment.

3 Claims, 4 Drawing Sheets

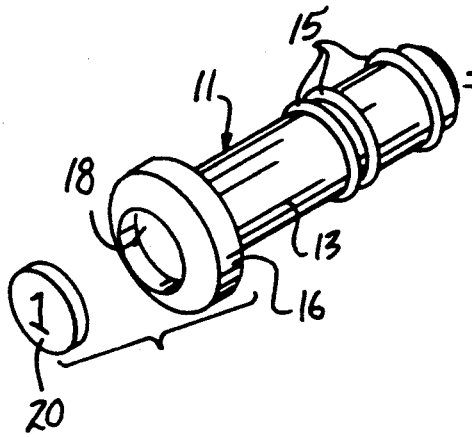
Fig 1
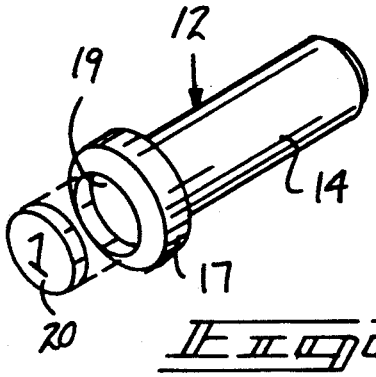
Fig 2
1- YELLOW
2-GREEN
3-RED
4-BLUE
5-ORANGE
21a
Fig 3
Fig 4
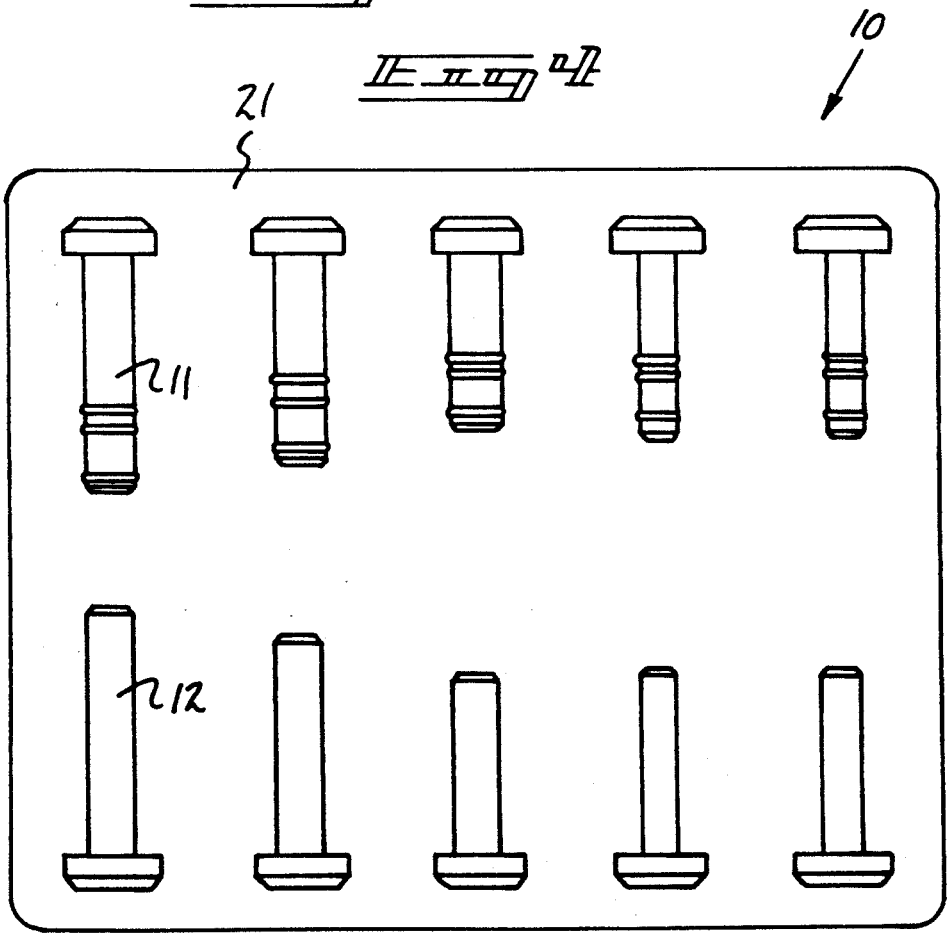

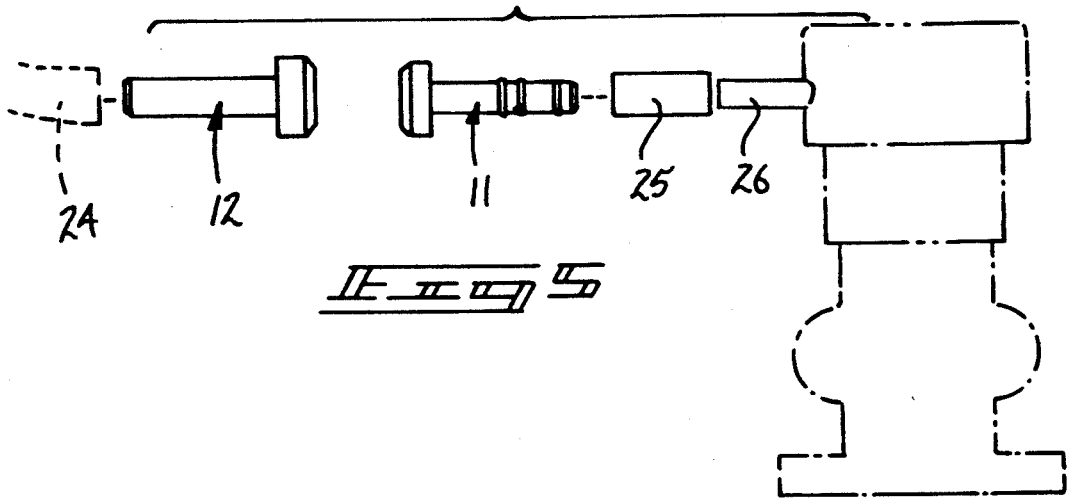
Fig 5
Fig 6
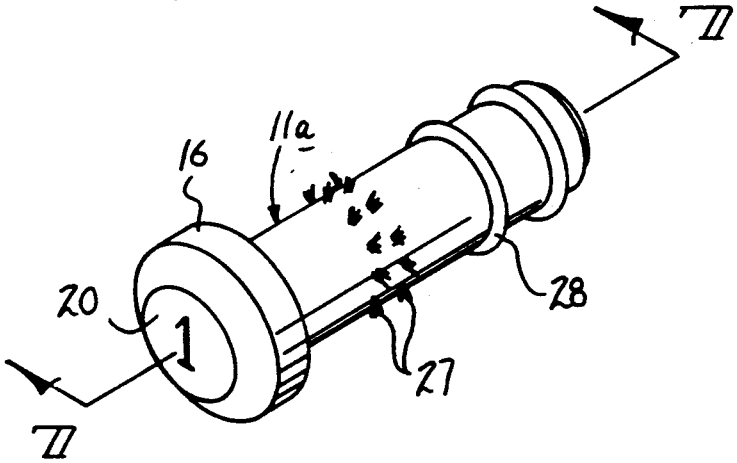
Fig 7
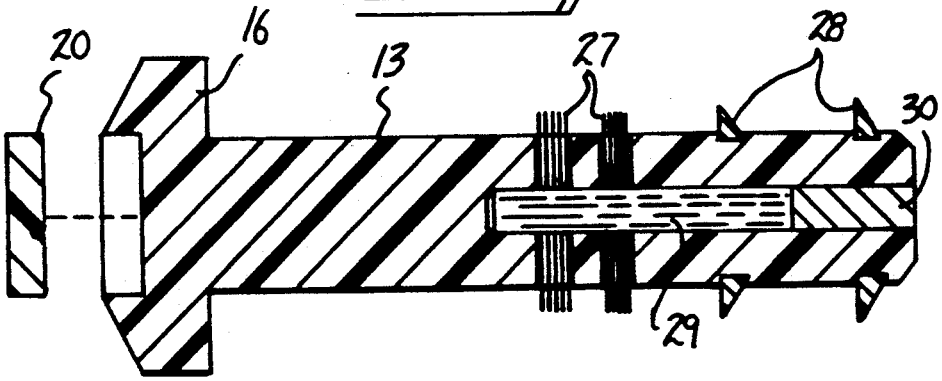

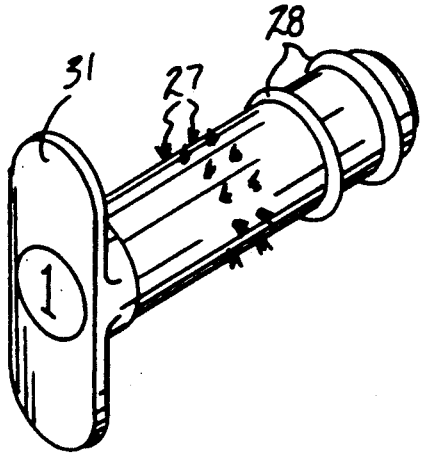
Fig 8
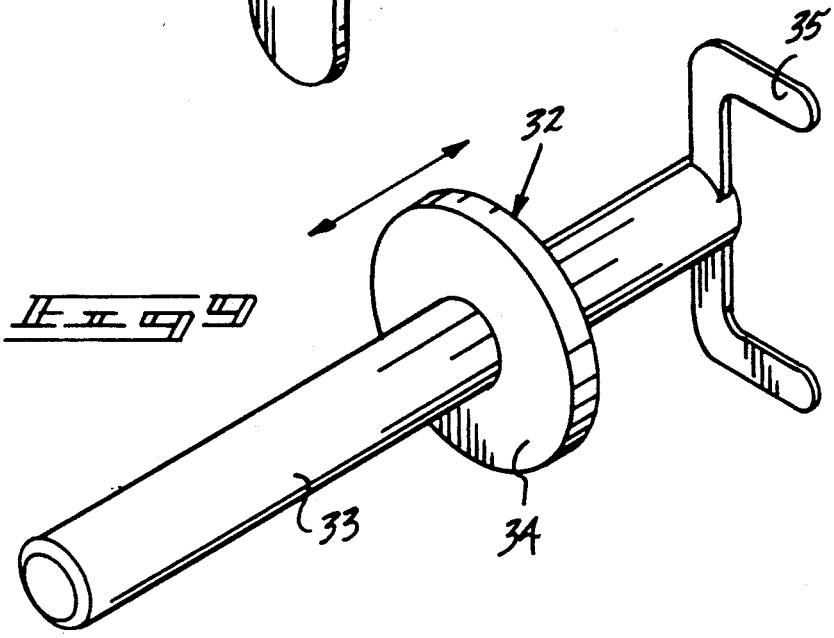
Fig 9
Fig 10
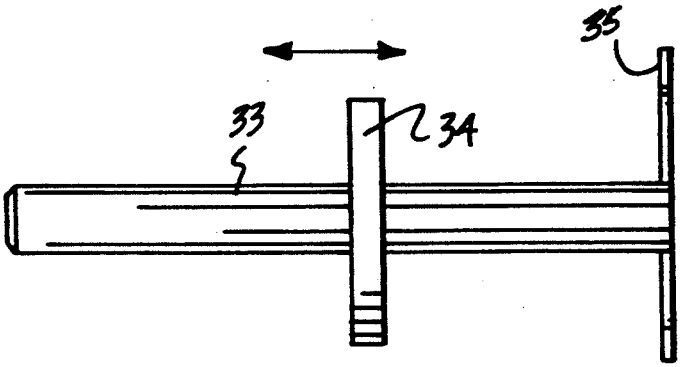
Fig 11
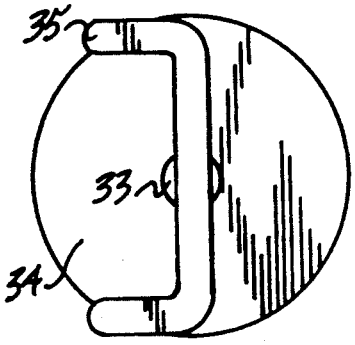

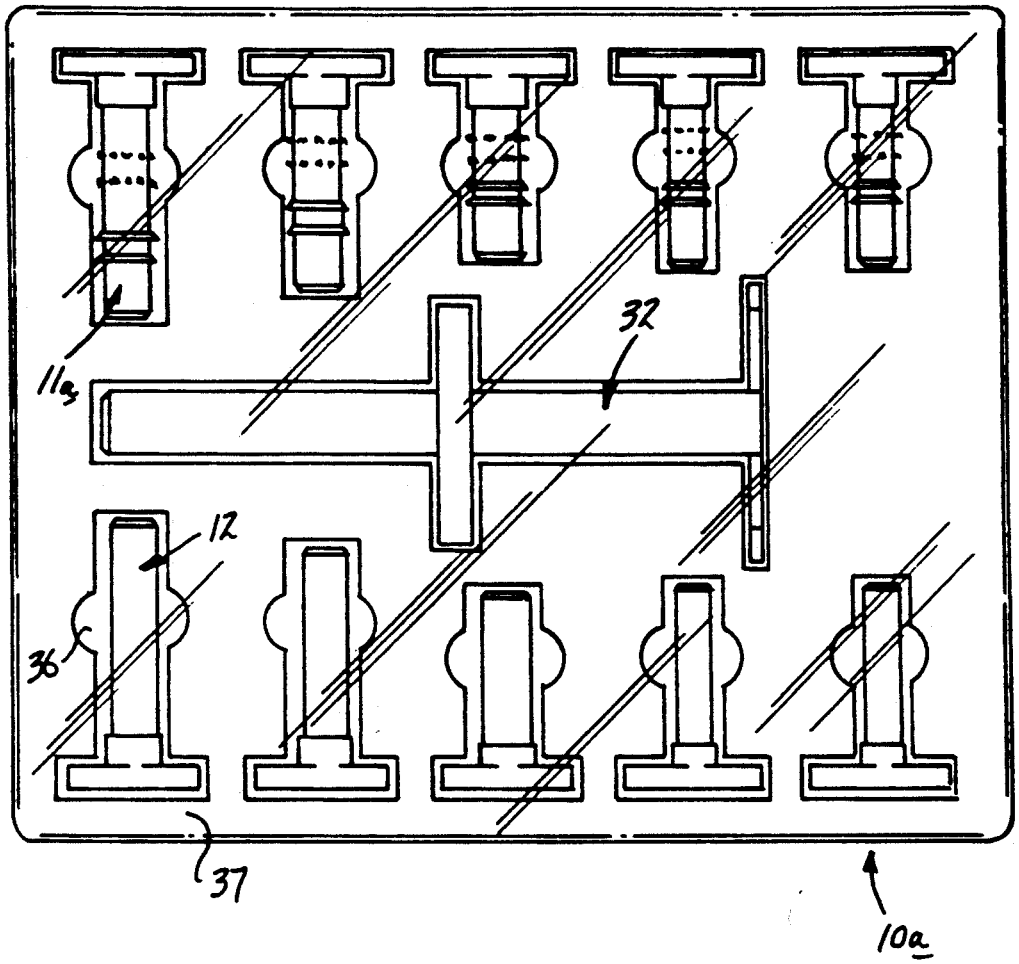
Fig 12
Fig 13
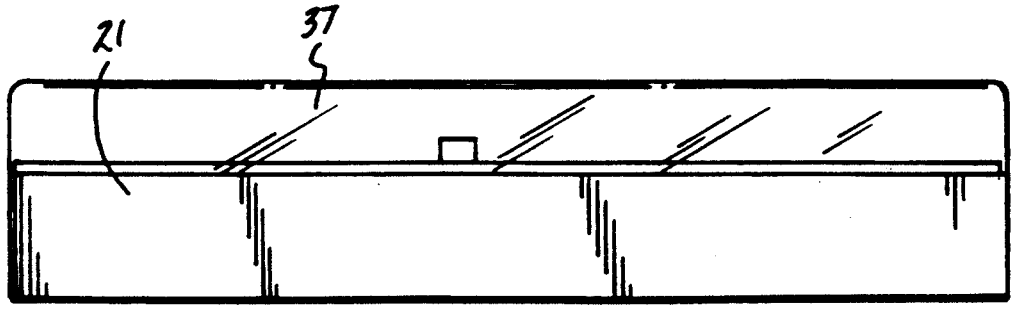

VACUUM LINE MARKER KIT

BACKGROUND OF THE INVENTION

1. Field of the Invention

The field of invention relates to marker apparatus, and more particularly pertains to a new and improved vacuum line marker kit wherein the same provides for plural paris of markers for use in marking vacuum lines to maintain association with a vacuum source relative to a removed vacuum line during separation of the vacuum source and vacuum line.

2. Description of the Prior Art

In automotive repair, vacuum lines are frequently removed from a vacuum source, wherein in the myriad of vacuum line connections available in contemporary automotive construction, lines are easily switched and confused relative to an associated source. The instant invention sets forth a marker organization to provide immediate identification of a vacuum source and vacuum line to permit ease of reassembly at a subsequent time period.

The prior art has utilized identification apparatus to assist in identification of various organizations and are exemplified in U.S. Pat. No. 4,856,819 to Gollon wherein a tag structure utilizes a plurality of flexible segment connectors to associate product and a code associated therewith.

U.S. Pat. No. 4,507,883 to Tarrant sets forth a diskette labeling system to provide various labels on various portions of a disk and envelope structure associated with each disk.

As such, it may be appreciated that there continues to be a need for a new and improved vacuum line marker kit as set forth by the instant invention which addresses both the problems of ease of use as well as effectiveness in construction in providing visual association of a vacuum source and vacuum line for subsequent reconnection and in the respect, the present invention substantially fulfills this need.

SUMMARY OF THE INVENTION

In view of the foregoing disadvantages inherent in the known types of marker apparatus now present in the prior art, the present invention provides a vacuum line marker kit wherein the same utilizes pairs of plug members to plug associated vacuum lines and vacuum source to ease reassembly. As such, the general purpose of the present invention, which will be described subsequently in greater detail, is to provide a new and improved vacuum line marker kit which has all the advantages of the prior art marker apparatus and none of the disadvantages.

To attain this, the present invention provides a kit apparatus including plural pairs of plug members of varying corresponding sizes, wherein at least one plug member of the pair includes a smooth cylindrical body, with an enlarged head mounted thereon for sealing relationship relative to vacuum lines, wherein an opposed plug member of the pair includes a cylindrical body with an enlarged head and at least including a plurality of concenric sealing rings to enhance sealing securement with a corresponding vacuum line when a vacuum line is separated from a vacuum source, such as in a carburetor in an automotive environment.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved vacuum line marker kit which has all the advantages of the prior art marker apparatus and none of the disadvantages.

It is another object of the present invention to provide a new and improved vacuum line marker kit which may be easily and efficiently manufactured and marketed.

It is a further object of the present invention to provide a new and improved vacuum line marker kit which is of a durable and reliable construction.

An even further object of the present invention is to provide a new and improved vacuum line marker kit which is susceptible of a low cost of manufacture with regard to both materials and labor, and which accordingly is then susceptible of low prices of sale to the consuming public, thereby making such vacuum line marker kits economically available to the buying public.

Still yet another object of the present invention is to provide a new and improved vacuum line marker kit which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a first typical marker of a marker pair utilized by the instant invention.

FIG. 2 is an isometric illustration of a second marker of a marker pair utilized by the instant invention.

FIG. 3 is an orthographic bottom view of a support housing providing a code imprinted thereon.

FIG. 4 is an orthographic top view of a housing utilized by the invention for mounting the various pairs of vacuum plug members.

FIG. 5 is an orthographic side view of a pair of plug members in use.

FIG. 6 is an isometric illustration of a modified first plug member.

FIG. 7 is an orthographic view, taken along the lines 7—7 of FIG. 6 in the direction indicated by the arrows.

FIG. 8 is an isometric illustration of the modified first plug member utilizing a further head configuration.

FIG. 9 is an isometric illustration of a tool utilized by the instant invention in the kit organization.

FIG. 10 is an orthographic side view of the tool as set forth in FIG. 9.

FIG. 11 is an orthographic end view of the tool, as set forth in FIG. 9.

FIG. 12 is an orthographic top view of the modified kit construction, as set forth by the instant invention.

FIG. 13 is an orthographic end view, taken in elevation, of the kit and associated support housing of the instant invention.

DESCRIPTION OF THE PREFERRED EMBODIMENT

With reference now to the drawings, and in particular to FIGS. 1 to 13 thereof, a new and improved vacuum line marker kit embodying the principles and concepts of the present invention and generally designated by the reference numerals 10 and **10*a*** will be described.

More specifically, the vacuum line marker kit 10 of the instant invention essentially comprises a first plug member 11 operative with a second plug member 12, each of a predetermined diameter. A plurality of such pairs of plug members 11 and 12 are provided within an associated support housing 21, with each pair of the first and second plug members 11 and 12 including a respective first and second cylindrical body 13 and 14, each of a like predetermined diameter. Each respective first and second cylindrical body includes a respective first and second head 16 and 17 respectively defined by a further diameter greater than the predetermined diameter. The first cylindrical body 13 includes a plurality of parallel concentric ribs 15 to enhance internal engagement with an associated connector hose 25 for subsequent securement to a rigid vacuum conduit 26 of a vacuum source, such as a carburetor, as illustrated in FIG. 5. The second cylindrical body 14 of a smooth exterior surface, as illustrated in FIG. 2, is received within a vacuum hose priorly connected to the rigid vacuum conduit 26. Each respective first and second heads 16 and 17 includes a respective first and second cylindrical cavity 18 and 19 to receive a marker member 20 that is removably mounted within the cavity to indicate numerical association of each vacuum hose and associated vacuum conduit 24 and 26 respective, as well as providing a like coloration, as indicated on the support housing bottom wall **21*a*** associating each enumeration with an associated coloration.

The modified vacuum line marker kit organization is depicted in FIGS. 12 and 13 includes a support housing 21 including respective support housing cavities 36, each complementarily receiving a first and second plug member **11*a* and 12*a* therewithin. The support housing 36 includes a transparent lid 37. The modified first plug member 11*a* includes a plurality of rows of concentric annular brush rings 27. Each brush ring is in fluid communication with a fluid reservoir 29 coaxially positioned within the first cylindrical body 13, wherein the brush rings 27 positioned above a plurality of flexible annular cleaning ribs 28. In this manner, projection of the first plug member 11*a* within a vacuum hose 24 effects a cleaning and lubrication of the hose to permit ease of reassembly of the vacuum hose 24 with the vacuum conduit 26. Typically, the fluid reservoir 29 includes a lubricating fluid therewithin. A removable plug 30 is mounted coaxially through a bottom end of the first cylindrical body 13 to permit replenishment of the reservoir 29**.

FIG. 8 illustrates a modified head plate 31 in lieu of the cylindrical head 16 that is formed on the first and second cylindrical bodies 13 and 14. The plate member is longitudinally aligned relative to itself and orthogonally oriented relative to the cylindrical body. A removable tool 32 is provided and mounted removable within the support housing 21 and an associated cavity 36, wherein the removable 32 includes a cylindrical tool body 33 including a cylindrical slide disk 34 mounted reciprocatably about the tool body, with a "C" shaped hook 35 mounted at a forward terminal end of the cylindrical tool body 33. The "C" shaped hook 35 includes parallel legs that are oriented orthogonally relative to the axis of the cylindrical tool body 33. In this manner, the head plate 31 is positioned between the slide disk 34 and an associated "C" shaped hook 35 of the tool 32 to permit ease of grasping of the associated plug member for removal from an associated vacuum hose or connector hose.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A vacuum line marker kit, comprising in combination, a support housing, the support housing including plural pairs of opposing cavities contained therewithin, and a lid overlying the cavities mounted to the support housing, and each pair of cavities includes a first plug member and a second plug member defining a plug pair, the first plug member defined by a first cylindrical body, and the second plug member defined by a second cylindrical body, the first cylindrical body and the second cylindrical body defined by a predetermined diameter, and the first cylindrical body including a first head mounted thereon, the second cylindrical body including a second head mounted thereon, the first head including a first cylindrical cavity, and the second head including a second cylindrical cavity, the first and second head including a removably mounted marker cylinder contained therewithin, the marker cylinders defining a predetermined coloration and predetermined indicia, and each said plug pair of said each pair of cavities of a contrasting coloration relative to said predetermined coloration and of contrasting indicia relative to said predetermined indicia, and the first cylindrical body includes a plurality of concentric ribs integrally mounted to said first cylindrical body, and the first cylindrical body further includes a central fluid reservoir contained within the first cylindrical body, the first cylindrical body including a lower terminal end spaced from said first head, and a removable plug removably mounted through the lower terminal end of the first cylindrical body to effect replenishment of the fluid reservoir, and the first cylindrical body including a plurality of bristle brush rings, wherein each of the rings includes a plurality of bristle members, wherein each of the bristle members is in fluid communication with the fluid reservoir to direct fluid contained within the fluid reservoir through the bristles.

2. An apparatus as set forth in claim 1 wherein the ribs are defined by flexible annular rings positioned below the brush rings.

3. An apparatus as set forth in claim 2 wherein the marker kit includes a removable tool mounted within the support housing.

* * * * *